US008161714B2

(12) United States Patent
Data

(10) Patent No.: US 8,161,714 B2
(45) Date of Patent: Apr. 24, 2012

(54) CAPPING CHUCK

(76) Inventor: Michael Scott Data, New Castle, PA (US)

( * ) Notice: Subject to any disclaimer, the term of this patent is extended or adjusted under 35 U.S.C. 154(b) by 46 days.

(21) Appl. No.: 12/577,271

(22) Filed: Oct. 12, 2009

(65) Prior Publication Data

US 2010/0089004 A1 Apr. 15, 2010

Related U.S. Application Data

(60) Provisional application No. 61/105,153, filed on Oct. 14, 2008.

(51) Int. Cl.
*B67B 3/10* (2006.01)

(52) U.S. Cl. ..... 53/343; 53/329

(58) Field of Classification Search ..... 53/287, 53/317, 329, 331.5, 334, 342, 343, 368
See application file for complete search history.

(56) References Cited

U.S. PATENT DOCUMENTS 4,364,218 A * 12/1982 Obrist ..... 53/331.5
4,599,846 A * 7/1986 Ellis et al. ..... 53/331.5
4,674,264 A * 6/1987 Ellis et al. ..... 53/331.5
5,197,258 A * 3/1993 Johanek ..... 53/317
5,313,765 A * 5/1994 Martin ..... 53/317
5,437,139 A * 8/1995 Martin ..... 53/317
5,490,369 A * 2/1996 Ellis et al. ..... 53/317
5,687,552 A * 11/1997 Barca ..... 53/490
5,714,820 A * 2/1998 Mitsuhashi et al. ..... 310/105
6,240,678 B1 * 6/2001 Spether ..... 53/317
6,945,011 B2 * 9/2005 Hidding et al. ..... 53/167
7,181,892 B1 * 2/2007 Scott et al. ..... 53/331.5
7,334,380 B2 * 2/2008 Brunee ..... 53/317

* cited by examiner

*Primary Examiner* — Paul R Durand
(74) *Attorney, Agent, or Firm* — James R. Williams

(57) ABSTRACT

A capping chuck for a bottle capping machine is capable of applying a pre-defined torque to a cap and reducing top load during application. The capping chuck includes a drive gear mechanically connected to a clutch. The clutch controls the torque transmitted to a gripper head through a driveshaft. The gripper head secures the cap to the bottle, and includes a substantially continuous perimeter wall surrounding a plunger that moves under load in a direction parallel to the longitudinal axis of the driveshaft. The extent of movement can be controlled by a resistance element such as, for example, a spring. An engagement device affects the contact the drive gear has with the bull gear of the capping mechanism. The engagement device can rotate the capping chuck relative to the bull gear to ensure positive engagement of the drive gear with the bull gear. The engagement device can include a slotted opening and an adjustment screw.

14 Claims, 9 Drawing Sheets

CAPPING CHUCK

The present invention claims priority to U.S. 61/105,153, which is hereby incorporated by reference.

FIELD OF THE INVENTION

The present invention relates to a chuck, particularly a capping chuck for use in applying a cap to a bottle.

BACKGROUND OF THE INVENTION

Filling and capping processes typically include conveying bottles to a filling station and capping them at a capping station. The processes can also include various testing and control functions such as, for example, testing and control of fill volume, cap torque, conveyor velocity, etc.

The capping station comprises a capping mechanism. The capping mechanism can include torque sensors and convertors, various cap head designs, rotary screw heads, conveying apparatus, and various capping chucks for holding the caps. Capping chucks secure the caps to the bottles. Capping chucks can include a clutch that limits the torque applied to the cap. The clutch can include a magnetic engagement that may be adjusted for various torque requirements.

Various applications require frequent cleaning of the capping mechanism. In these applications, a reduction in surface area or mechanical junctions can facilitate cleaning and reduce downtime.

SUMMARY OF THE INVENTION

The present invention describes a capping chuck for a bottle capping machine. The capping chuck is capable of applying a pre-defined torque to a cap with reduced top load during application. The capping chuck includes a drive gear mechanically connected to a clutch which drives a jaw. The gripper head secures the cap to the bottle.

In one embodiment, the drive gear is mechanically connected to the clutch. A driveshaft connects the clutch to the jaw. A shield can protect the driveshaft. Preferably, the shield is perforated.

The gripper head includes a perimeter wall surrounding a base. The perimeter wall can be serrated to improve contact with the cap. The perimeter wall can also be tapered toward the base. Under load, the plunger can move in a direction parallel to the longitudinal axis of the driveshaft. The extent of movement can be controlled by a resistance element such as, for example, a spring.

The clutch is preferably separated from the gripper head by the driveshaft. The clutch can control the amount of torque at the jaw. The clutch can include friction or magnetic elements, and preferably can be adjusted. In an embodiment, the clutch includes at least two magnetic arrays that are disposed in opposite polarity. The magnetic array can include a plurality of magnetic elements. The mutual magnetic repulsion of the magnetic arrays controls the amount of torque at the jaw. When the torque exceeds the mutual magnetic repulsion, the clutch slips.

The drive gear can engage a bull gear on the capping mechanism. The bull gear is capable of driving a plurality of drive gears. The capping chuck can include an engagement device that ensures good contact of the drive gear with the bull gear. The engagement device can rotate the capping chuck relative to the bull gear to ensure positive engagement of the drive gear with the bull gear. The engagement device can include a slotted opening and an adjustment screw.

DETAILED DESCRIPTION OF THE INVENTION

Figure 1:
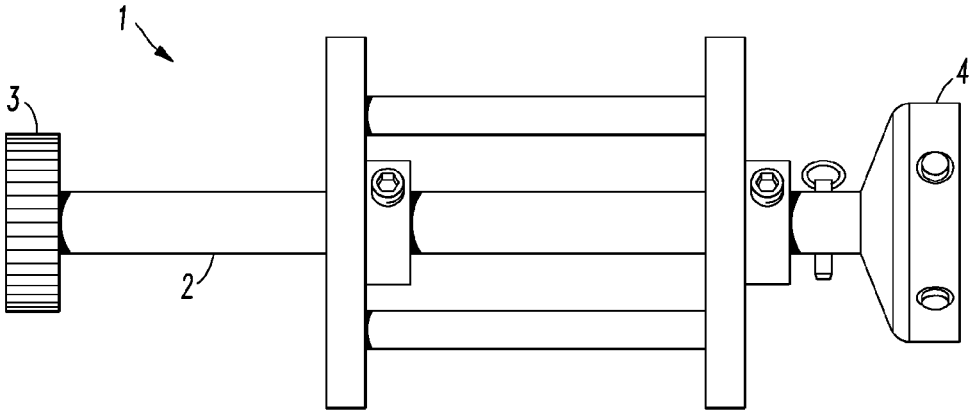
PRIOR ART FIG. 1
FIG. 1 shows a first capping chuck of the prior art.
Figure 2:
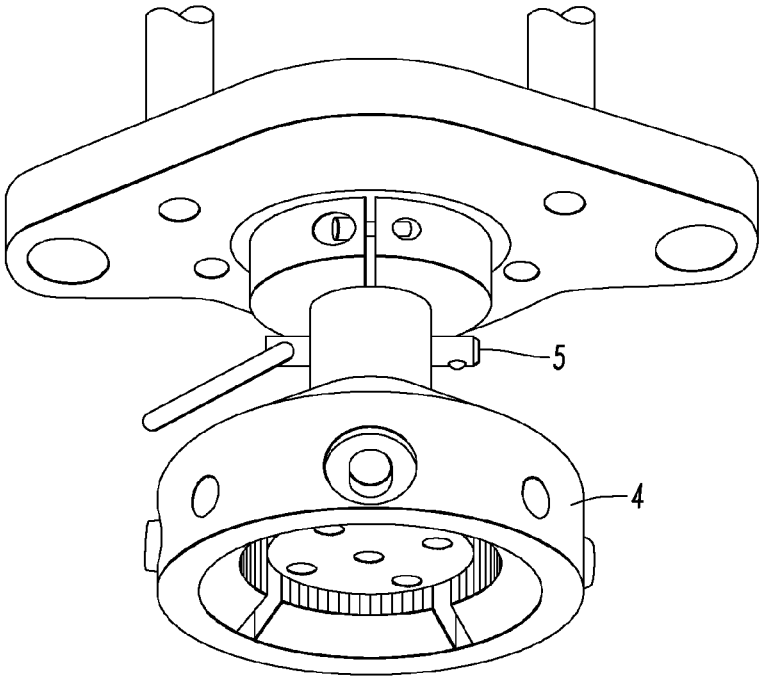
FIG. 2 PRIOR ART
FIG. 2 shows the gripper head of FIG. 1.
Figure 3:
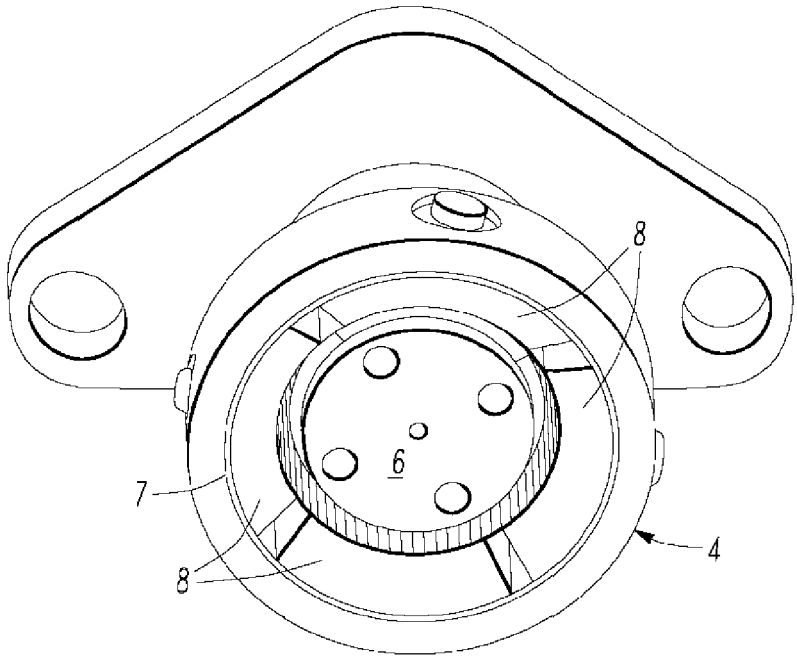
PRIOR ART FIG. 3
FIG. 3 shows the gripper head of FIG. 1 along a longitudinal axis.

As shown in FIGS. 1-3, a capping chuck 1 can include a driveshaft 2 that mechanically connects a drive gear 3 to a gripper head 4. The drive gear 3 engages a bull gear (not shown) of a capping mechanism. In a multi-stage capping mechanism, the bull gear can drive a plurality of capping chucks. The bull gear rotates the drive gear 3 and the drive shaft 2 transfers the rotation to the gripper head 4. In embodiments, the gripper head 4 is secured to the driveshaft 2 with a retention pin 5. Removal of the retention pin 5 permits removal of the gripper head 4 from the driveshaft 2.

The gripper head 4 can include a plunger 6 surrounded by a perimeter wall 7. The perimeter wall 7 is discontinuous and consists of a plurality of gripper jaws 8. The gripper jaws 8 typically consist of arc sections in combination forming a discontinuous perimeter. The plunger 6 and gripper jaws 8 are normally in an expanded position. Pressure on the plunger 6 causes the gripper jaws 8 to move inwardly. In practice, the capping chuck 1 is pressed down onto a cap (not shown), the gripper jaws 8 move inwardly thereby gripping the cap, and the driveshaft 2 rotates the gripper head 4 until the cap is secured to the bottle. An operator must carefully monitor the capping operation or excess torque can cause the gripper head 4 to strip the cap causing closure failure. Alternatively, excessive pressure can crush the bottle.

Figure 4:
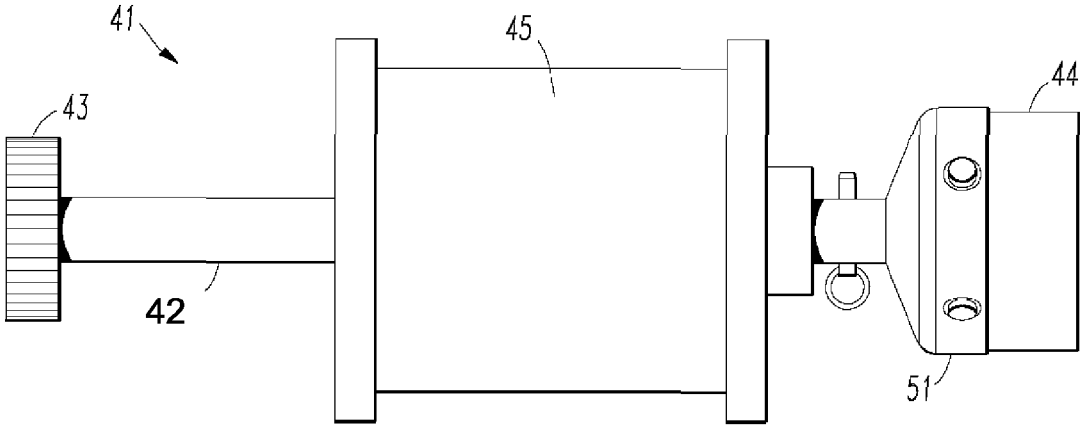
FIG. 4 PRIOR ART
FIG. 4 shows a second capping chuck of the prior art.
Figure 5:
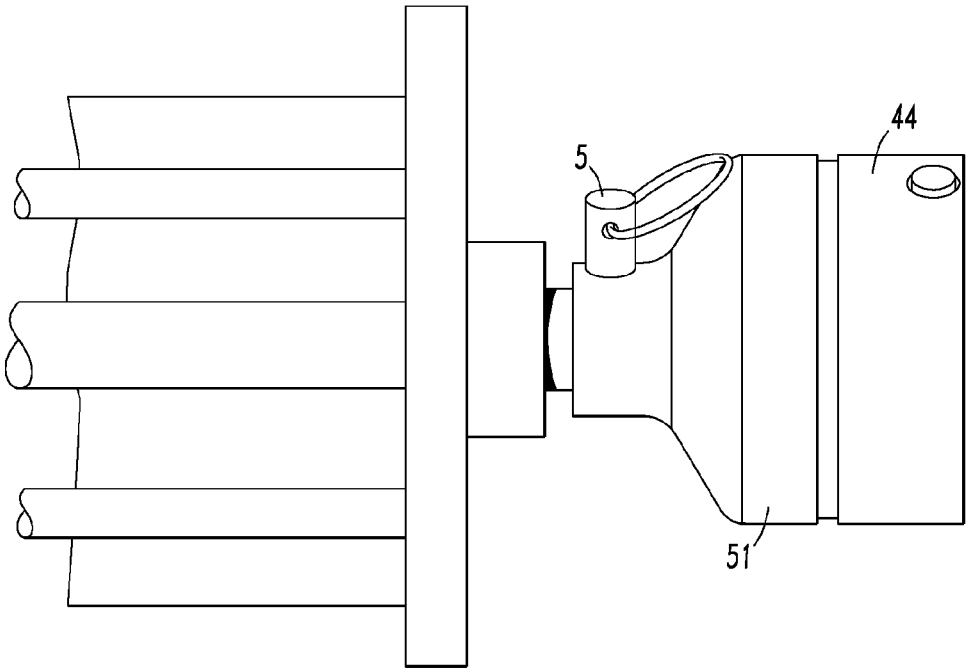
FIG.5 PRIOR ART
FIG. 5 shows the gripper head and the clutch of FIG. 4.
Figure 6:
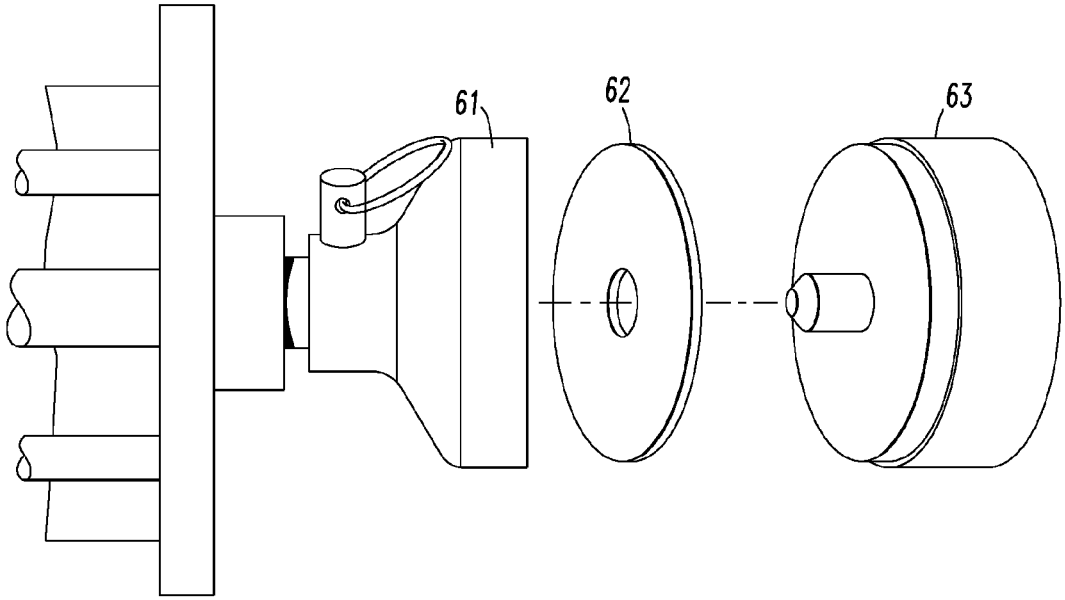
FIG.6 PRIOR ART
FIG. 6 is an exploded view of the clutch of FIG. 4.
Figure 7:
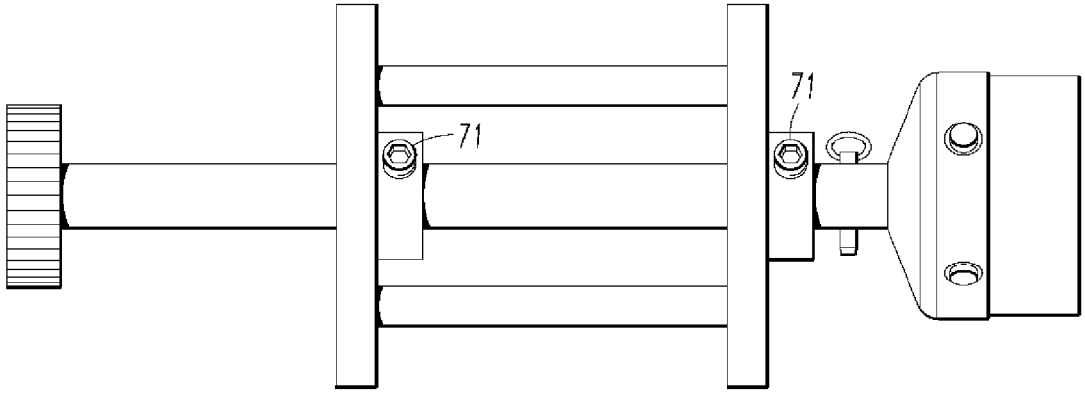
PRIOR ART FIG. 7
FIG. 7 shows the capping chuck of FIG. 4 without the protective cover.
Figure 8:
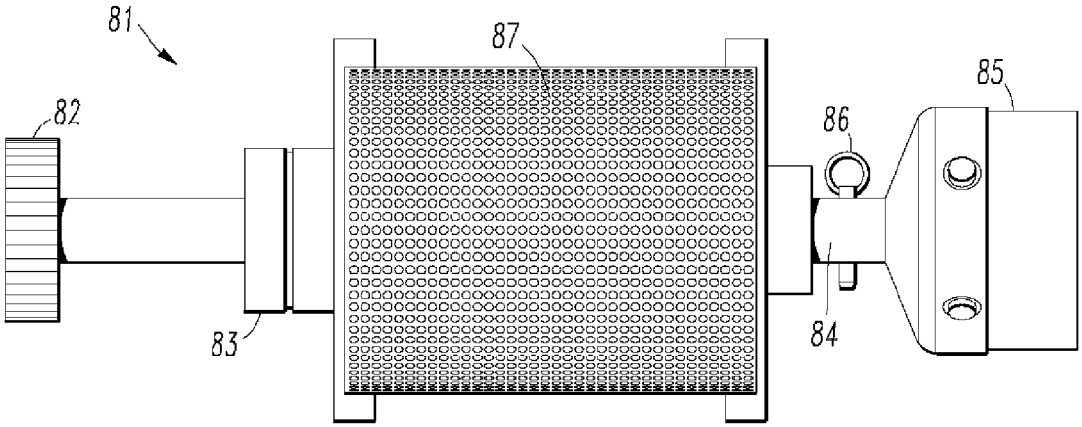
FIG. 8 shows an embodiment of the capping chuck of the present invention.

FIGS. 4-6 show another embodiment of a capping chuck. FIG. 7 shows a reverse view of the capping chuck. The capping chuck 41 includes a driveshaft 42 connecting a drive gear 43 to a gripper head 44. The gripper head 44 includes a clutch 51 that can limit the torque transferred from the driveshaft 42 to the gripper head 44. In this embodiment, the clutch 51 includes a first magnetic portion 61 separated by a spacer 62 from a second magnetic portion 63. The strength of the magnetic portions 61, 63 and the thickness and material of the spacer 62 control the torque limit. Typically, the spacer comprises a plastic such as, for example, unsubstituted and substituted polyolefins; although, any convenient substance can be used. While this embodiment can limit torque, it also has its problems. Liquid can infiltrate the clutch 51 and affect the torque transmitted to the gripper head 44. For example, liquid can reduce friction so that the gripper head 44 does not impart sufficient force to the caps. Alternatively, dried residue can increase torque and strip the caps. Cleaning can be difficult because the clutch is part of the gripper head and is subject to splashing liquid. Cleaning involves disassembly of the clutch. Shields 45 have been used to reduce cleaning; however, shields can also complicate sanitation and cleaning. Rust can form in areas that are difficult to reach. Removing the rust can require removing the capping chuck from the capping mechanism.

FIGS. 8-12 show an embodiment of the present invention. A capping chuck 81 comprises a drive gear 82 mechanically connected to a clutch 83. A driveshaft 84 connects the clutch 83 to a gripper head 85. The driveshaft 84 also separates the clutch 83 from the gripper head 85. Separating the clutch 83 and the gripper head 85 permits cleaning the gripper head 85 without disassembling the clutch 83. In embodiments, the clutch 83 can be at least about 10 centimeters (about 3.937 inches) from the gripper head 85.

The drive gear 82 and clutch 83 can be connected by an upper shaft 111. The clutch can include any known mechanism including, for example, friction pads, magnetic elements, and combinations thereof. Conveniently, an adjustment bolt 110 can alter the torque that the clutch 83 transmits to the driveshaft 84 and gripper head 85. The adjustment bolt 110 can operate, for example, to increase a spring tension or to separate elements of the clutch. For example, the adjustment bolt of a magnetic clutch can move apart the magnetic elements. The adjustment bolt 110 permits changing the applied torque without disassembling the clutch 83.

In embodiments, a retaining pin 86 can secure the gripper head 85 to driveshaft 84. A shield 87 can at least partially cover the driveshaft 84. In operation, the shield can deflect liquid splatter from the driveshaft 84 and protect equipment operators from the driveshaft 84. The shield 87 can be perforated. Perforation can facilitate cleaning.

The gripper head 85 includes a plunger 92 surrounded by a substantially continuous perimeter wall 91. The perimeter wall 91 can extend to the gripper head opening. The perimeter wall 91 consists essentially of a single piece and is tapered to receive a cap (not shown). The taper diverges from the plunger 92 at an angle of at least about 1°, and preferably from about 2° to about 5°. The taper will have a first diameter at the gripper head 85 opening that is slightly larger than the cap and a second diameter at the plunger 92 that is slightly smaller than the diameter of the cap. Optionally, the second diameter can change with movement of the plunger 92. The first diameter permits the gripper head 85 to receive the cap and the second diameter permits retention of the cap. In embodiments, the plunger 92 can undergo a displacement along the longitudinal axis 88 of the driveshaft 84 in response to a force. Movement of the plunger 92 inwardly from the gripper head 85 opening can decrease the second diameter. A resistance element (not shown) can control the plunger's ease of movement. The resistance element can be, for example, a spring or other elastic element. Advantageously, the taper reduces the compressive force required along the longitudinal axis 88 when compared to gripper heads having a jaw comprising arc sections.

The perimeter wall 91 and plunger 92 can preferably travel along the longitudinal axis 88 so that the gripper head 85 remains in contact with a cap as the cap is secured to a bottle. Conveniently, the length of travel can be at least about ¼ inch (about 0.635 centimeter). Prior art capping chucks require a longitudinal load to be placed on the gripper head to ensure contact with the cap. The load ensures the arc sections of the gripper jaws engage the cap during substantially the entire capping process. An excessive load could crush or otherwise distort small or thin-walled bottles, but insufficient load would not secure the cap to the bottle. The present invention requires little or no longitudinal load to engage the capping chuck to the cap. Sealing is improved and bottles can have thinner walls.

Figure 14:
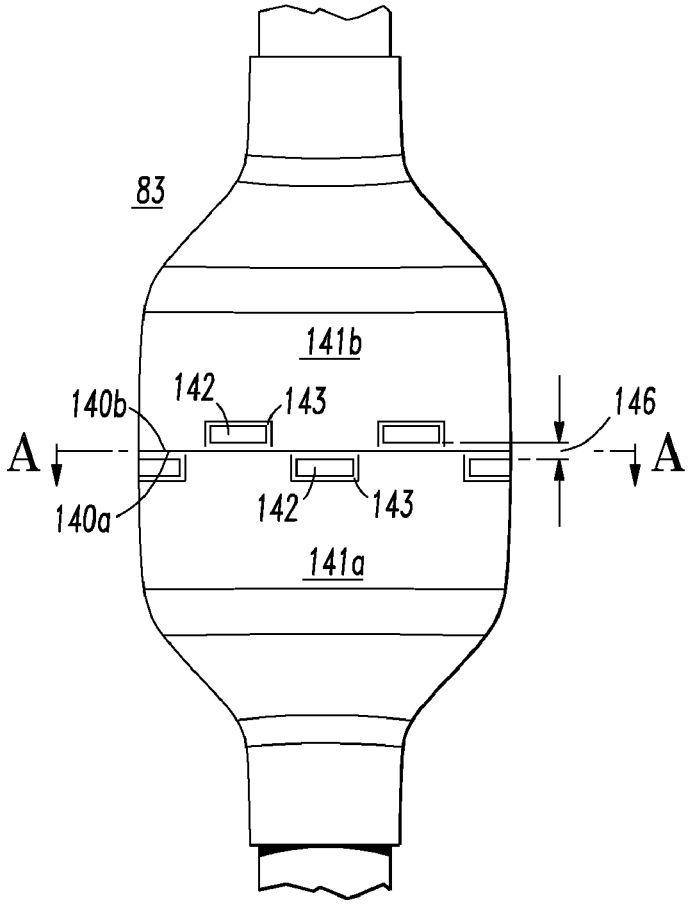
FIG. 14 shows a cross-section of an embodiment of a clutch of the present invention.
Figure 15:
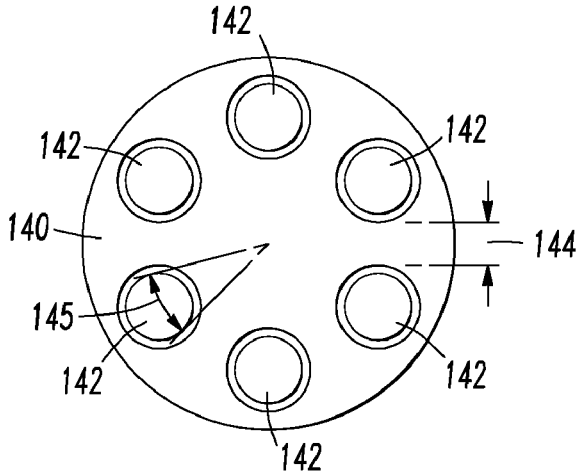
FIG. 15 is a cross-section of FIG. 14 through A-A.

The capping chuck can include a clutch 83 as shown in FIGS. 14 and 15. The clutch 83 includes at least two opposing mating surfaces 140. Each mating surface 140 includes a magnetic array 141*a*, 141*b*. Each magnetic array 141 includes at least one magnet 142. In embodiments, the mating surfaces 140 can define cavities 143 into which the magnets are recessed. The magnet 142 can be any suitable magnetic device including, for example, a permanent magnet, an electromagnet, or a combination thereof. In embodiments, the magnetic arrays 141 includes a plurality of magnets 142 disposed on the mating surface 140. Magnetic clutches of the prior art separate the mating surfaces with a spacer. This is necessary because the magnets are arranged in opposite polarity, which draws the magnets on opposing mating surfaces towards one another. The spacer prevents the magnets from sticking together. Changing the thickness of the spacer will change the mutual attraction of the magnets, and so will change the torque at which the clutch will slip. The magnets must also be fixed into the cavities or they can pop out.

In the present invention, the magnetic arrays 141 are arranged so that the magnets 142 present the same magnetic pole towards the mating surface 140. This ensures that the magnets 142 of a first magnetic array 141*a* repel the magnets 142 on a second magnetic array 141*b*. This repulsion causes the clutch 83 to operate so long as the torque on the clutch 83 does not exceed the repulsion force of the magnetic arrays 141. Conveniently, the magnetic arrays 141 include a plurality of magnets 142 that are disposed so that the distance 144 between magnets 142 is at least equal to the radial arc 145 of the magnets 142. The clutch 83 can work with only one magnet 142 on each mating surface 140; however, additional magnets 142 will produce a smoother mechanism. Advantageously, placing the magnets 142 in polar opposition pushes the magnets 142 into the cavities 143 so magnets 142 are less prone to popping out. Further, while a spacer can be used to separate the magnets 142, it is not necessary as the mutual repulsion of the magnets 142 can create a suitable spacing 146 between the magnetic arrays 141.

Figure 9:
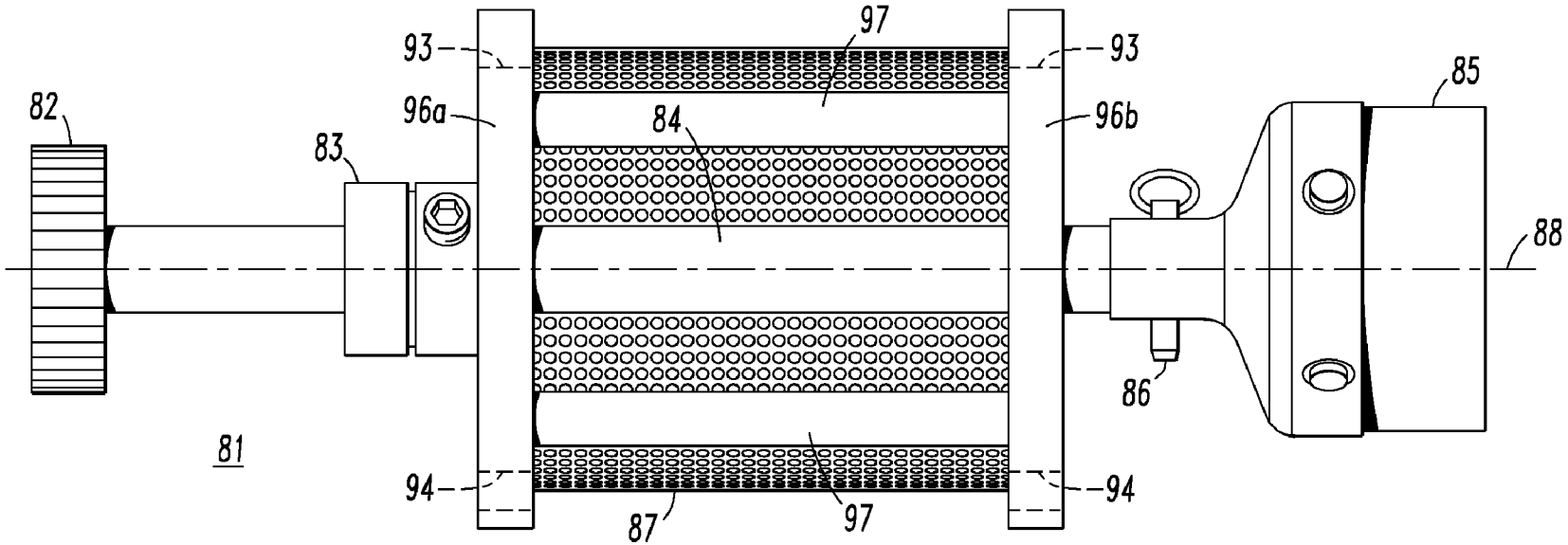
FIG. 9 shows a rear view of FIG. 8.
Figure 10:
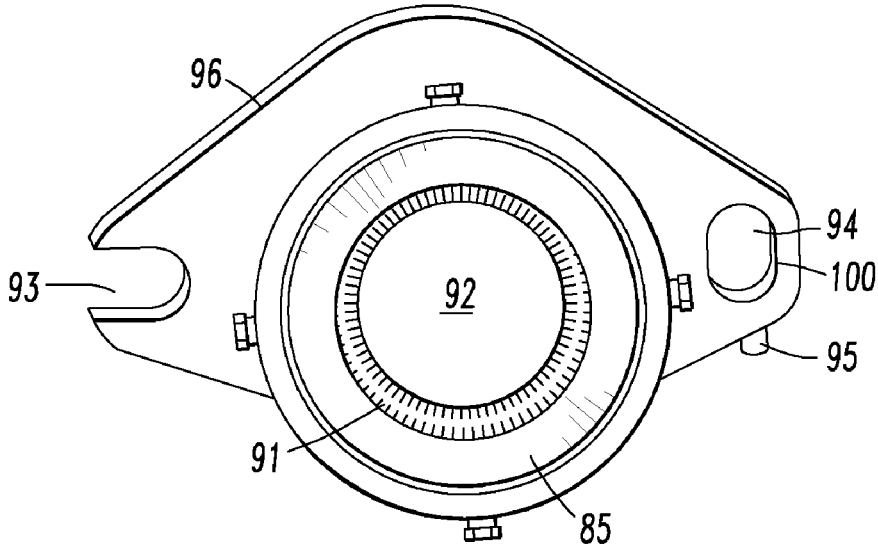
FIG. 10 shows the gripper head of FIG. 8 along a longitudinal axis.
Figure 11:
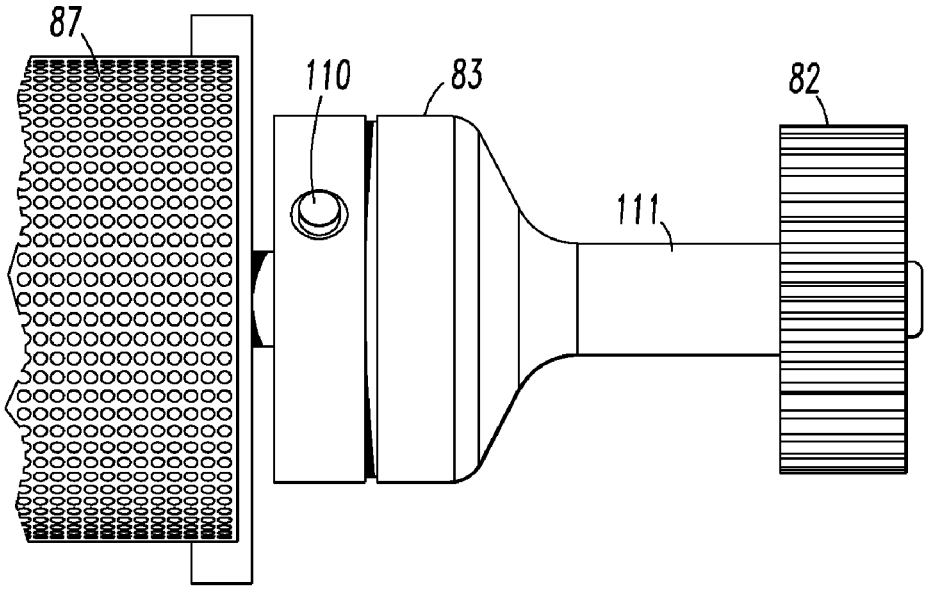
FIG. 11 shows the clutch and driving gear of FIG. 8.
Figure 12:
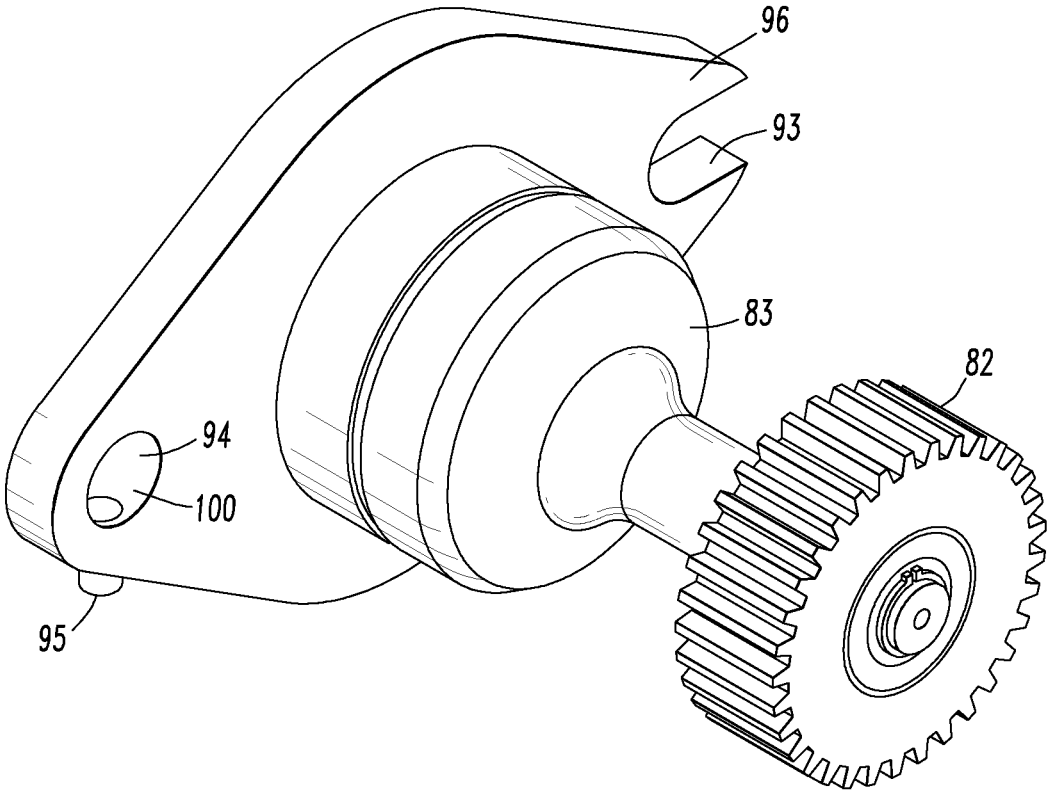
FIG. 12 shows a perspective view of the driving gear and an engagement device.
Figure 13:
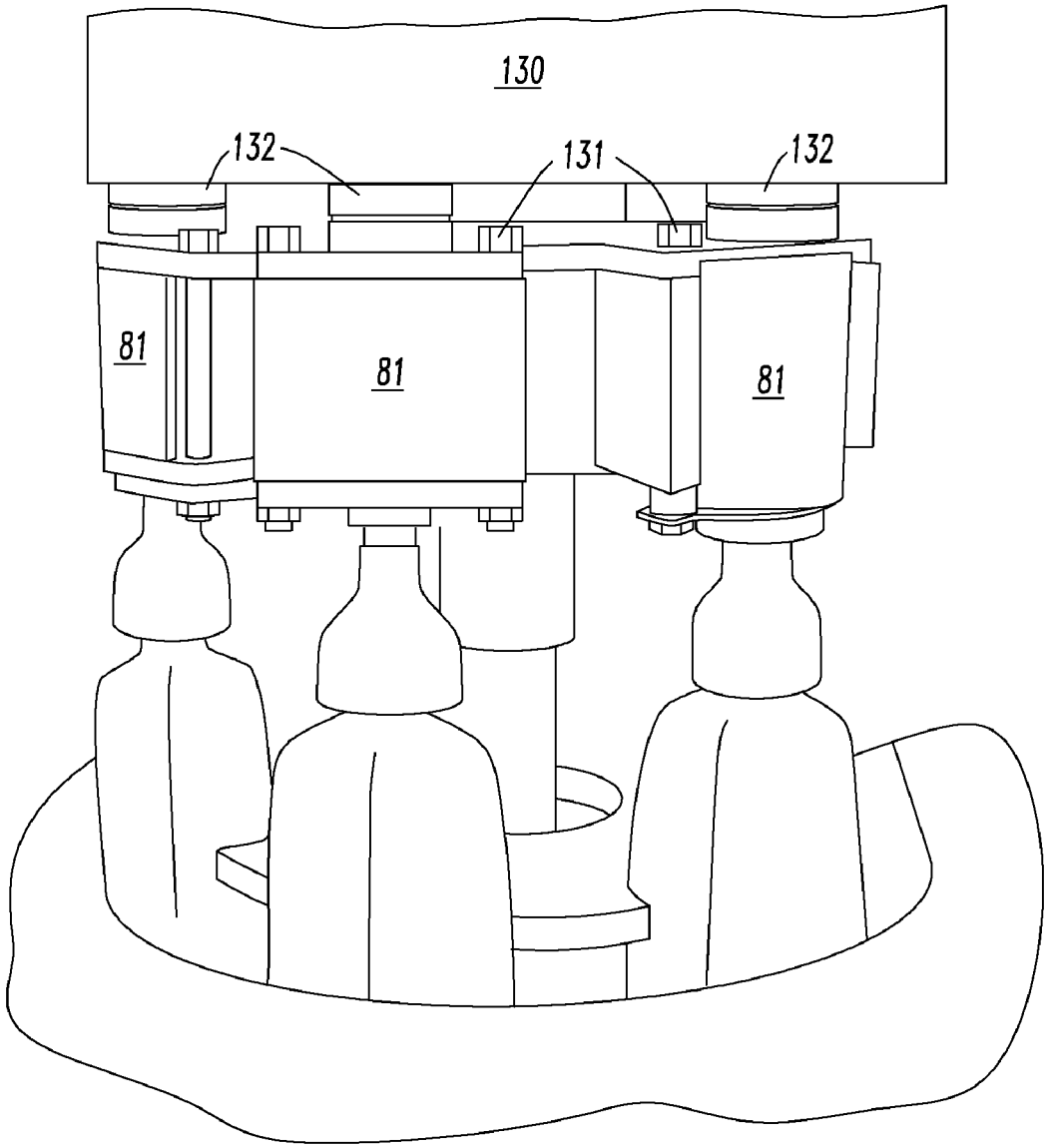
FIG. 13 shows the capping chuck of the present invention on a capping mechanism.

As shown in FIG. 13, the capping chuck 81 can include a frame for securing the capping chuck 81 to a capping mechanism 130. In embodiments, the capping mechanism 130 can operate a plurality of capping chucks 81. With reference to FIG. 9, the frame can include a pair of plates 96*a*, 96*b* united by spacer rods 97. The driveshaft 84 extends through both plates 96. The driveshaft 9 can pass through bushings (not shown) in each plate 96 to facilitate rotation of the driveshaft 84.

A typical installation of the capping chuck 81 on the capping mechanism 130 includes a connector 131 such as, for example, a pair of lag bolts on the capping mechanism 130 that secures the capping chuck 81 to the capping mechanism 130. The frame can define at least one slot 93 and opening 94 for receiving the lag bolts. The opening 94 will define a non-circular perimeter 100 so as to define at least one non-circular opening. The opening can be substantially oval. In embodiments, the plates 96 define a pair of slots 93 and openings 94. The paired slots 93 and openings 94 resist movement away from the longitudinal axis 88 but do permit the capping chuck 81 to rotate about the longitudinal axis 88.

Such rotation can affect the engagement of the drive gear 82 with the bull gear so that if the gears do not align the capping chuck can be rotated to attain alignment. An adjustment screw 95 that extends into the opening 94 can lock the capping chuck 81 in proper engagement.

Numerous modifications and variations of the present invention are possible. It is, therefore, to be understood that within the scope of the following claims, the invention may be practiced otherwise than as specifically described. While this invention has been described with respect to certain preferred embodiments, different variations, modifications, and additions to the invention will become evident to persons of ordinary skill in the art. All such modifications, variations, and additions are intended to be encompassed within the scope of this patent, which is limited only by the claims appended hereto.

The invention claimed is:

1. A capping chuck for a capping mechanism comprising a drive gear mechanically connected to a magnetic clutch comprising a plurality of opposing mating surfaces, each mating surface including a magnetic array comprising a magnet having a magnetic pole, and the magnet of one magnetic array presenting the same magnetic pole towards the opposing mating surfaces as the magnet on another magnetic array, the magnetic clutch transmitting torque to a gripper head through a driveshaft, whereby the clutch and the gripper head are separated.

2. The capping chuck of claim 1, wherein the torque transmitted to the gripper head can be adjusted.

3. The capping chuck of claim 1, wherein the driveshaft has a length and the length is at least about 10 centimeters (about 3.937 inches).

4. The capping chuck of claim 1, wherein the gripper head comprises a plunger surrounded by a substantially continuous perimeter wall that extends to a gripper head opening, the substantially continuous perimeter wall having a taper, the taper diverging from the plunger at an angle of at least about 1° so that the taper comprises a first diameter at the gripper head opening that is slightly larger than a diameter of a cap and a second diameter at the plunger that is slightly smaller than the diameter of the cap.

5. The capping chuck of claim 4, wherein the taper diverges from about 2° to about 5°.

6. The capping chuck of claim 4, wherein the second diameter changes as the plunger undergoes a displacement along a longitudinal axis in response to a force.

7. The capping chuck of claim 6, wherein a resistance element determines the displacement of the plunger in response to the force.

8. The capping chuck of claim 1, wherein the capping chuck comprises a frame defining a slot and a non-circular opening, the slot and opening adapted to receive a connector for securing the capping chuck to the capping mechanism, and an adjustment screw that extends into the opening and can lock the drive gear in proper engagement with a bull gear of the capping mechanism.

9. The capping chuck of claim 1, wherein the gripper head comprises a plunger capable of moving in a direction parallel to a longitudinal axis of the driveshaft of the capping chuck, the plunger surrounded by a substantially continuous perimeter wall that extends to a gripper head opening, the substantially continuous perimeter wall having a taper, the taper diverging from the plunger at an angle of at least about 1° so that the taper comprises a first diameter at the gripper head opening that is slightly larger than a diameter of a cap and a second diameter at the plunger that is slightly smaller than the diameter of the cap.

10. A capping chuck for a capping mechanism comprising a drive gear mechanically connected to a clutch that transmits torque to a gripper head, the clutch comprising a plurality of opposing mating surfaces, each mating surface including a magnetic array comprising a magnet having a magnetic pole, and the magnet of one magnetic array presenting the same magnetic pole towards the opposing mating surfaces as the magnet on another magnetic array.

11. The capping chuck of claim 10, wherein at least one magnetic array comprises a plurality of magnets.

12. The capping chuck of claim 11, wherein a distance separates the plurality of magnets of the magnetic array, and the distance between magnets is at least equal to a radial arc of the magnets.

13. The capping chuck of claim 10, wherein at least one opposing mating surface defines a cavity into which the magnetic array is recessed.

14. The capping chuck of claim 10, wherein the magnet is selected from a group consisting of a permanent magnet, an electromagnet, or a combination thereof.

* * * * *